United States Patent [19]

Ishii

[11] Patent Number: 4,673,062

[45] Date of Patent: Jun. 16, 1987

[54] POSITION CONTROL SYSTEM FOR ELEVATOR

[75] Inventor: Toshiaki Ishii, Ichinomiya, Japan

[73] Assignee: Mitsubishi Denki Kabushiki Kaisha, Tokyo, Japan

[21] Appl. No.: 785,717

[22] Filed: Oct. 9, 1985

[30] Foreign Application Priority Data

Oct. 15, 1984 [JP] Japan ..... 59-215812

[51] Int. Cl.[4] ..... B66B 3/02

[52] U.S. Cl. ..... 187/134

[58] Field of Search ..... 187/29 R; 318/310, 311, 318/312, 313, 450, 480, 563, 564, 565, 602; 340/19 R, 20

[56] References Cited

U.S. PATENT DOCUMENTS 4,387,436 6/1983 Katayama et al. ..... 187/29 R

FOREIGN PATENT DOCUMENTS 57-57391 12/1982 Japan .

*Primary Examiner*—William M. Shoop, Jr.
*Assistant Examiner*—Richard K. Blum
*Attorney, Agent, or Firm*—Leydig, Voit & Mayer

[57] ABSTRACT

A position control system for elevators including a plurality of pulse encoders which independently generate pulse signals in accordance with the movement of a cage. The pulse signals are respectively counted, and the operation of the cage is terminated when a difference in counted results between the encoders has exceeded a predetermined value. Thus, the cage can continue to operate even if there is a small difference between the counted results, and, when any of the pulse encoders malfunction, which triggers a substantially larger difference in counted results, the cage is controlled to stop the operation.

3 Claims, 7 Drawing Figures

POSITION CONTROL SYSTEM FOR ELEVATOR

BACKGROUND OF THE INVENTION

This invention relates to a position control system wherein the position of a cage is determined by counting the number of digital pulses are generated with the movement of the cage.

A conventional system which determines the position of a cage by such counting operation is disclosed in Japanese Patent Application Laid-open NO. 59-53379 in which.

FIG. 6 illustrates a similar arrangement. In the figure, numeral 1 designates a control device for an elevator, and numeral 2 a driving device for driving a motor 3. A speedometer 4 to be used for a speed control is directly coupled to the shaft of the motor 3 and produces pulse signals proportional to the rotational frequency of the motor 3. Numeral 5 indicates a hoist driven by the motor 3, numeral 6 a deflecting sheave, symbol 6*a* a main rope, numeral 7 a counterweight, and numeral 8 a cage. Shown at numeral 9 is a fixed point detecting switch mounted on a hoistway wall 9*a*. When the cage 8 has just arrived at a floor F, the switch 9 is actuated by a cam 10 mounted on the cage 8 and provides a fixed point signal 9*s*. An endless steel tape 11 is extended between a tape wheel 12 which is disposed at the lowermost position of a hoistway, and a tape wheel 13 which is disposed at the uppermost position of the hoistway. It is fixed to the cage 8 midway, to rotate the tape wheels 12 and 13 in accordance with the movement of the cage 8. A rotary disc 14 is directly coupled to the rotary shaft 13*a* of the tape wheel 13, and is formed with slits 14*a* along its outer periphery. A pulse encoder 15 includes a light projector on one side and a light receptor on the other side with the rotary disc 14 intervening therebetween. It senses light passing through the slits 14*a*, to generate signal pulses and transmit them to the counter 16 of the control device 1 so as to detect the movement distance of the cage 8.

Next, the operation of the prior-art system will be described.

First, the cage 8 is caused to arrive at the floor F by a maintenance run. At this time, the fixed point detecting switch 9 comes in fit engagement with the cam 10 and sends the fixed point signal 9*s* to the control device 1. The counter 16 is set to an initial value by the fixed point signal 9*s*.

When an up run command is issued from the control device 1, the motor 3 brings the cage 8 to an up run. With the ascent of the cage 8, the steel tape 11 moves to rotate the rotary disc 14. The signal pulses are generated from the pulse encoder 15 by the slits 14*a*. These signal pulses are added to the initial value of the counter 16. Since the generation interval of the pulse signals corresponds to a distance, the position of the cage 8 can be detected on the basis of the number of the signal pulses.

Subsequently, when a down run command is issued, the motor 3 brings the cage 8 to a down run. In the down run, each time a signal pulse is generated from the pulse encoder 15, it is subtracted from the content of the counter 16.

In this manner, the count value of the counter 16 is subjected to addition or subtraction with the ascent or descent of the cage 8. Besides, the generation interval of the signal pulses corresponds to the distance. Therefore, the position of the cage 8 can be detected from the count value.

The prior-art position control system for the elevator, however, includes only one pulse encoder as described above. When the pulse encoder malfunctions, the position of the cage cannot be properly detected. In consequence, the door of the cage might open despite the fact that the cage has stopped between floors. In case of such a malfunction, passengers not only cannot go to desired floors but a very dangerous situation occurs in that the passengers possibly will not realize that the cage has stopped between floors and could fall from the cage into the hoistway.

SUMMARY OF THE INVENTION

This invention has been made in order to eliminate such problems, and has for its object to prevent the occurrence of any unforeseen accident by determining whether or not the operation of the detector of a cage is normal and to stop the cage when an abnormality is confirmed.

A position control system for an elevator according to this invention comprises a plurality of pulse encoders each of which generates a signal pulse in accordance with a movement distance of a cage, a plurality of counters each of which counts up and down the signal pulses in correspondence with running directions of the cage, difference value detection means to detect a difference of count values of the counters, comparison means operable when the difference count values detected by the difference value detection means exceeds a predetermined value, and operation check means operable on the basis of a compared result of the comparison means.

According to the position control system for an elevator in this invention, the plurality of pulse encoders generate the signal pulses with the movement of the cage, these signal pulses are respectively counted so as to determine the difference of count values between them, and the cage is stopped only when the difference exceeds the predetermined value.

BRIEF DESCRIPTION OF THE DRAWINGS

FIG. 2 to FIG. 5(*b*) illustrate the details of the embodiment shown in FIG. 1, in which:

FIG. 2 is an arrangement diagram showing the whole elevator;

FIG. 3 is a partial detailed diagram;

FIG. 4 is a flow diagram of a program;

FIGS. 5(*a*) and 5(*b*) are explanatory diagrams; and

In the drawings, the same symbols indicate identical or corresponding portions.

PREFERRED EMBODIMENT OF THE INVENTION

Figure 1:
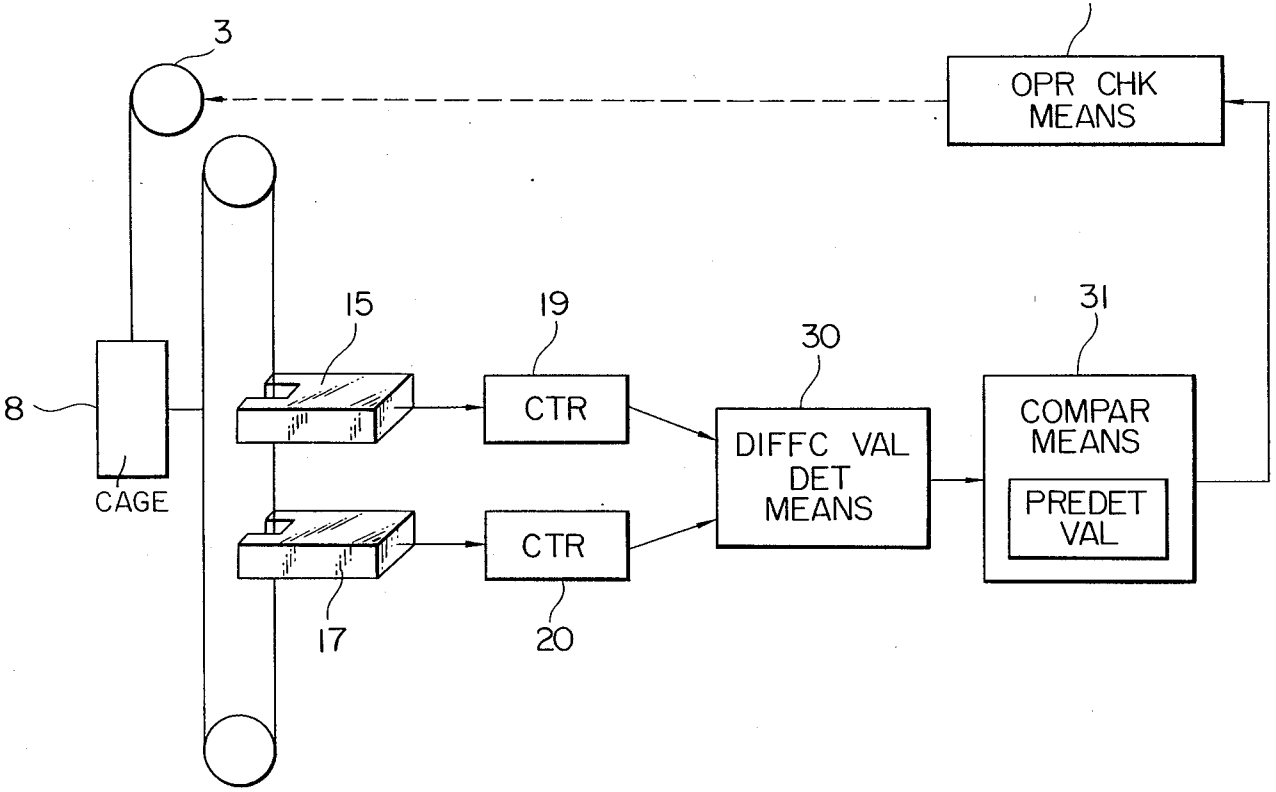
FIG. 1 is a generally arrangement diagram of an embodiment of a position control system for an elevator according to this invention.

FIG. 1 is a general arrangement diagram of one embodiment of a position control system for an elevator according to this invention. As apparent from FIG. 1, this embodiment is constructed of a plurality of pulse encoders, herein shown as pulse encoders 15, 17, each of which generates a signal pulse each time a cage 8 moves a predetermined distance, a plurality of counters, herein shown as counters 19, 20 each of which counts up and down the pulse signal signal pulses depending on whether the cage is driven in an up or down direction, difference value detection means 30 for determining the difference of count values between the counters 19, 20, comparison means 31 for comparing the difference of counter values with a predetermined value, and operation check means 32 for operating the cage 8 on the basis of the compared result.

FIGS. 2 to 5(*b*) show the details of the embodiment shown in FIG. 1. In the figures, the same symbols as in FIG. 6 indicate identical portions.

Figure 2:
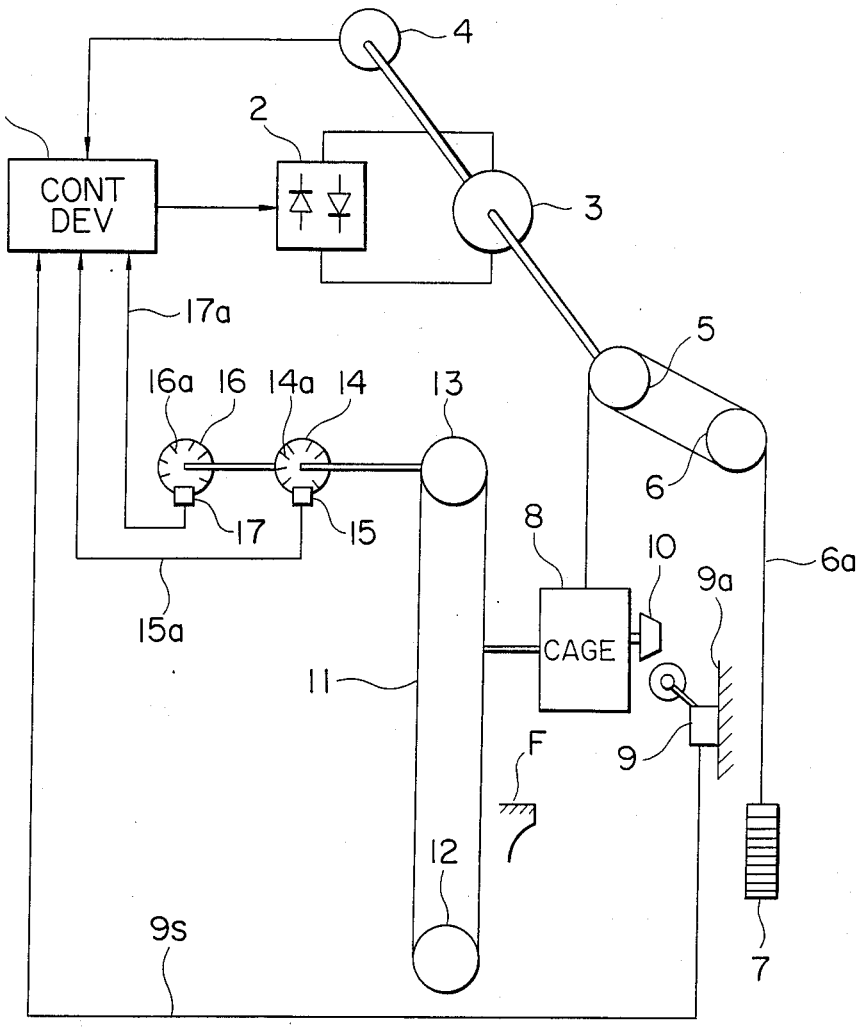

Referring first to FIG. 2, symbol 9*s* designates the fixed point signal path from the fixed point detecting switch 9 to the control device 1, numeral 14 a rotary disc formed of slits 16*a* in its outer periphery, symbol 15*a* the pulse signal pulse path from the pulse encoder 15 to the control device 1, and numeral 16 a rotary disc having similar construction as that of the rotary disc 14. Numeral 17*a* designates a signal path between the pulse encoder 17 which is of similar construction as that of the pulse encoder 15 and the control device 1.

Figure 3:
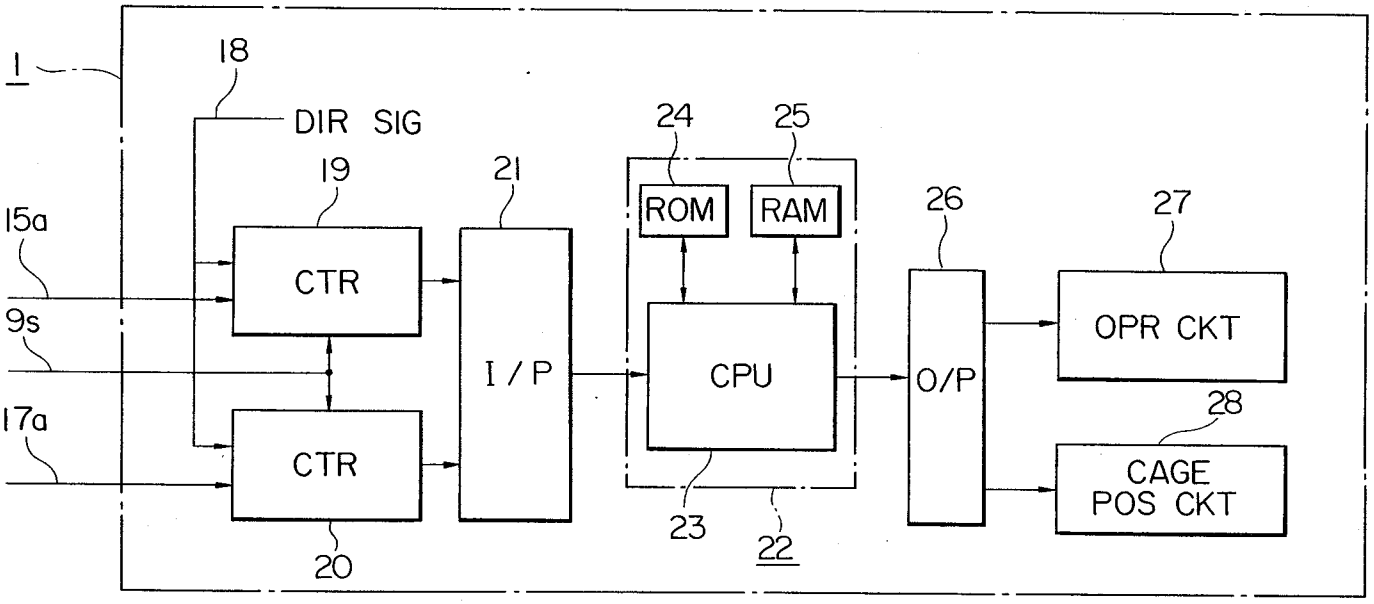

Referring to FIG. 3, numeral 18 designates a direction signal generated in the control device 1 in accordance with the running direction of the cage 8. The counters 19 and 20 are set to an initial value when the fixed point signal 9*s* is input thereto and counts up or down in response to the signal pulses 15*a* and 17*a* depending on whether the direction signal 18 represents an up or down running direction of the cage. Numeral 21 designates an input port (hereinbelow, termed 'I/P') which receives the count values of the counters 19 and 20. Numeral 22 designates a microcomputer (hereinbelow, termed 'MC') composed of a central processing unit (hereinbelow, abbreviated to 'CPU') 23, a read only memory (hereinbelow, abbreviated to 'ROM') 24 and a random access memory (hereinbelow, abbreviated to 'RAM') 25. Numeral 26 denotes an output port (hereinbelow, termed 'O/P') which delivers the calculated result of the MC 22, and numeral 27 an operation circuit for the motor 3, which is deenergized by the output of the O/P 26 so as to stop the motor 3. A cage position circuit 28 provides a display of the position of the cage 8.

Figure 4:
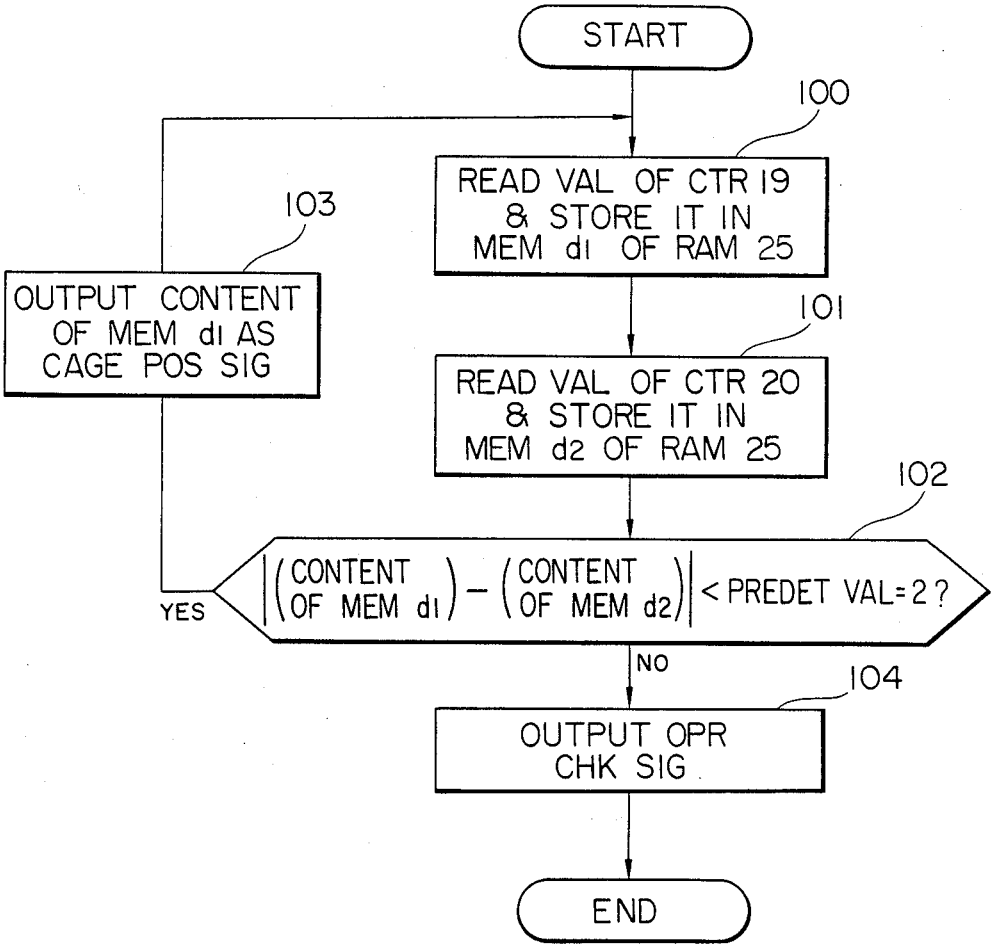

FIG. 4 is a flow chart of a program stored in the ROM 24.

Now, the operation of the embodiment will be described.

First, the cage 8 is caused to arrive at the floor F to actuate the fixed point detecting switch 9. Due to this actuation, a fixed point signal 9*s* is produced to set the counters 19 and 20 to an.

When running command for the up direction is issued from the control device 1, the rotary discs 14 and 16 rotate with the ascent of the cage 8. Each time the slot 14*a* passes through the pulse encoder 15 and the slit 16*a* through the pulse encoder 17, pulses 15*a* and 17*a* are respectively generated. Assuming that the direction signal 18 is an up direction signal, the signal pulses 15*a* and 17*a* are respectively counted up by the counters 19 and 20.

Figure 5:
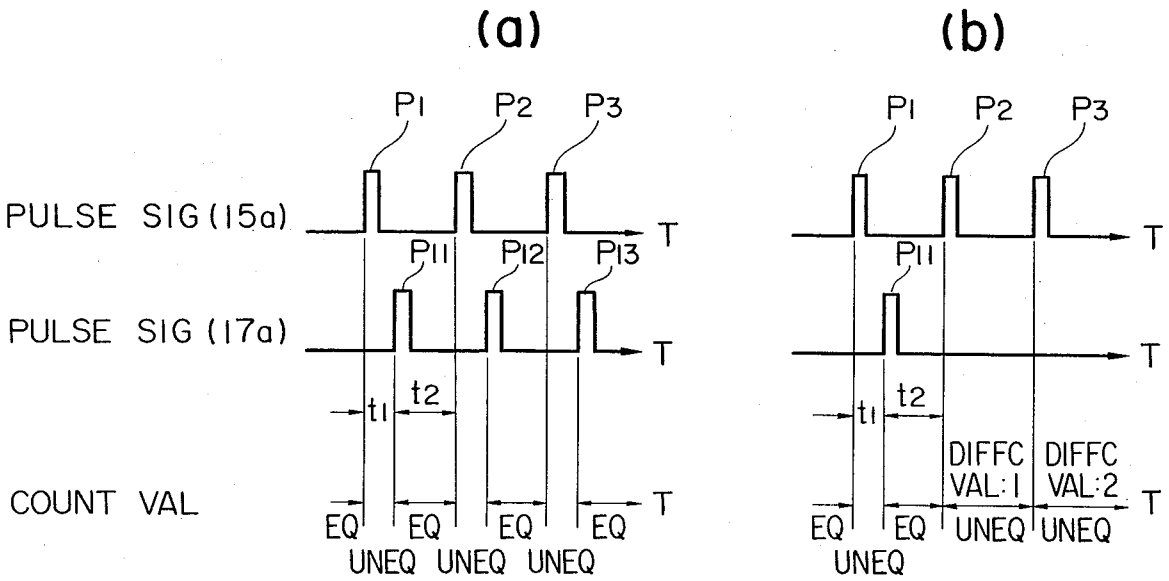
Figure 6:
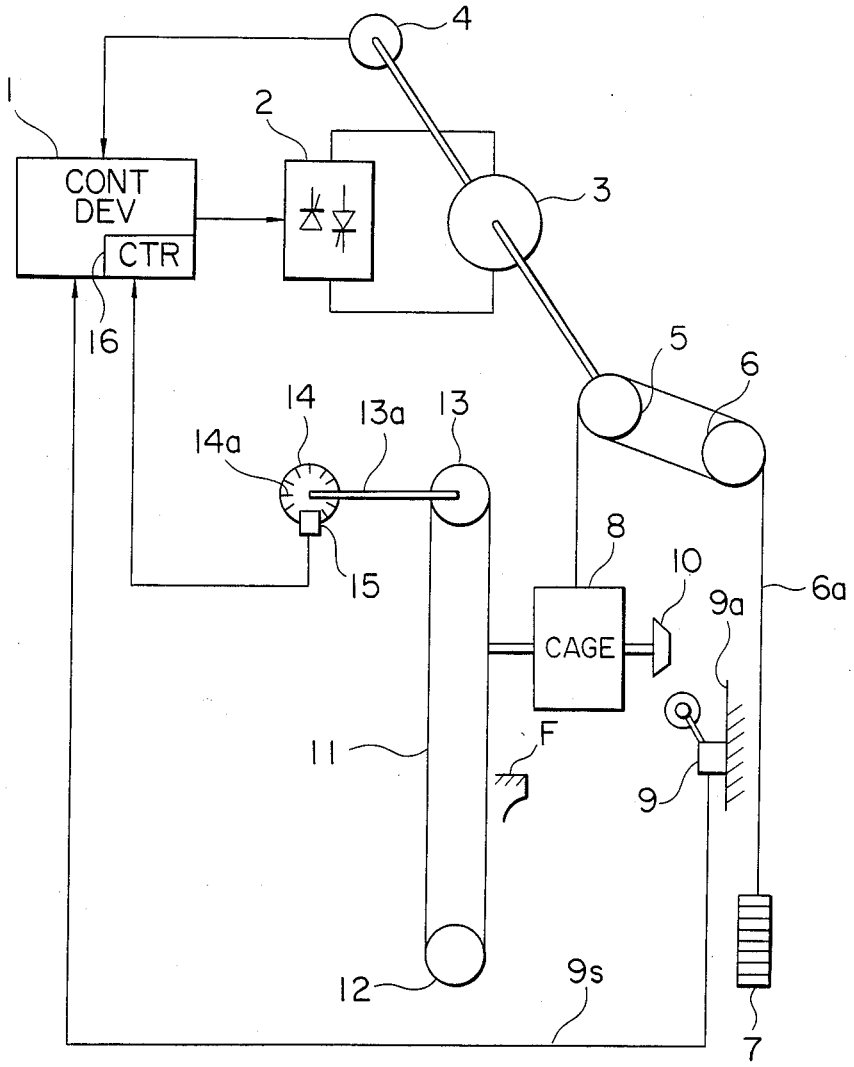
FIG. 6 PRIOR ART
FIG. 6 is a diagram corresponding to FIG. 2, showing a prior-art position control system for an elevator.

In practice, even though the rotary discs 14 and 16 and the pulse encoders 15 and 17 are similar in construction. the phases of the pulse signals 15*a* and 17*a* may shift as illustrated in FIG. 5(*a*). More specifically, it is assumed that a signal $P_{11}$ be generated from the pulse encoder 17 with a delay of $t_1$ after the generation of a signal $P_1$ from the pulse encoder 15 so that a signal $P_2$ generated from the pulse encoder 15 observes a delay of $t_2$ with respect to $P_{11}$. On this occasion, the count values of the counters 19 and 20 are not equal for the period of $t_1$ of $t_1$ in FIG. 5(*a*) but are equal for the period of $t_2$. This condition also applies to other succeeding signals $P_3, \ldots$ and $P_{12}, P_{13}, \ldots$ In the MC 22, the value of the counter 19 is read through the I/P 21 and is stored in the memory $d_1$ of the RAM 25 at a step 100 in FIG. 4. Also, the value of the counter 20 is stored in the memory $d_2$ of the RAM 25 at a step 101. At a step 102, the absolute value of the difference between the content of the memory $d_1$ and that of the memory $d_2$ is taken an is compared with a predetermined value ('2' in this embodiment). Since the pulse encoders are operating normally, the absolute value of the difference becomes '0' (for the period of $t_2$) or '1' (for the period of $t_1$) as illustrated in FIG. 5(*a*). Accordingly, the step 102 decides 'YES', and the control flow proceeds to a step 103 at which the count value of the counter 19 stored in the RAM 25 is output as a cage position signal.

Next, it is assumed as illustrated in FIG. 5(*b*) that the pulse encoder 15 continue to normally operate to generate a pulse train $P_1, P_2, P_3 \ldots$, but the pulse encoder 17 due to a malfunction only generates the signal pulse $P_{11}$. Although the count values of the two pulse encoders 19 and 20 are equal and the difference therebetween is less than the predetermined value, for the $t_2$ period the difference in counted values between the pulse encoders 19 and 20 increases and exceeds the predetermined value for subsequent periods.

Under such determination, the MC 22 decides 'NO' at the step 102. In consequence, and an operation check signal is generated through the O/P 26 to deenergize the operation circuit 27 at a step 104. The deenergization brings the cage 8 to an emergency stop.

According to the above embodiment, the two pulse encoders are used, and when the difference in counted values of the signal pulses between the pulse encoders lies within the range of the predetermined value which is set to a value representing a maximum deviation between the pulse encoders for normal operation thereof, the cage operation is allowed to continue whereas when it exceeds the predetermined value, the cage is brought to an emergency stop. Therefore, a cage position between floors is not erroneously judged to be at a floor, at which doors are to be opened and, therefore passenger safety can be enhanced.

While, in the embodiment, the pulse train 17*a* has been assumed to become abnormal, the situation is similar even when the pulse train 15*a* has become abnormal. That is, since the difference of the contents of the memories $d_1$ and $d_2$ is calculated as the absolute value, the abnormality of either pulse encoder increases the difference value, and the abnormal state can be detected with a single predetermined value.

While the encoders 15 and 17 have been respectively associated with the rotary discs 14 and 16 on the identical shaft, the intended object can be achieved even when either encoder is associated with a rotary disc which is driven by the deflecting sheave 6.

As can be seen, the present invention takes into account the utilization of a plurality of pulse encoders which generate signal pulses with the movement of a cage so that the signal pulses are respectively counted and compared to stop the operation of the cage when the difference in counted values of the pulse encoders has exceeded a predetermined value. Thus, when the pulse encoders are in the normal operating states thereof, the difference in the counted values is very small, and the cage can continue to operate, and when either pulse encoder malfunctions, as large difference in counted values is produced and the operation of the cage is stopped, so that the door of the cage is not opened at a level between floors. This brings forth the effect that the safety of the elevator operation can be enhanced.

I claim:

1. A position control system for an elevator comprising a plurality of pulse encoders, each generating spaced signal pulses upon movement of a cage a predetermined distance, a plurality of counters for up and down counting of the signal pulses generated from said pulse encoders depending on running directions of the cage, difference value detection means for determining any difference in counted values registered by said counters, comparison means for comparing the difference determined by said difference value detection means with a predetermined value for generating an operating signal representing the result of the comparison, and means for operating the cage in response to the operating signal of said comparison means.

2. A position control system for an elevator as defined in claim 1 wherein said difference value detection means determines the difference in counted values between said counters as an absolute value.

3. A position control system for an elevator as defined in claim 1 wherein the predetermined value is set to a value representing a maximum deviation between said pulse encoders for normal operation thereof, said operating means generating a control signal to stop the operation of the cage when the difference in counted values between said counters exceeds the predetermined value.

* * * * *